US010711560B2

(12) United States Patent
Schmidt et al.

(10) Patent No.: US 10,711,560 B2
(45) Date of Patent: Jul. 14, 2020

(54) WELLBORE PLUG SEALING ASSEMBLY

(71) Applicant: HALLIBURTON ENERGY SERVICES INC., Houston, TX (US)

(72) Inventors: Daniel Lee Schmidt, Duncan, OK (US); Brian Keith Ogle, Duncan, OK (US); Matt Brian Roseman, Duncan, OK (US); Kendell Lee Pacey, Duncan, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 133 days.

(21) Appl. No.: 15/576,315

(22) PCT Filed: Jul. 9, 2015

(86) PCT No.: PCT/US2015/039640
§ 371 (c)(1),
(2) Date: Nov. 22, 2017

(87) PCT Pub. No.: WO2017/007475
PCT Pub. Date: Jan. 12, 2017

(65) Prior Publication Data

US 2018/0148993 A1 May 31, 2018

(51) Int. Cl.
*E21B 33/12* (2006.01)
*E21B 33/129* (2006.01)
*E21B 34/06* (2006.01)

(52) U.S. Cl.
CPC ..... *E21B 33/1208* (2013.01); *E21B 33/1291* (2013.01); *E21B 33/1293* (2013.01); *E21B 34/06* (2013.01)

(58) Field of Classification Search
CPC .... E21B 43/105; E21B 43/108; E21B 33/128; E21B 33/1285; E21B 33/1208; E21B 33/129; E21B 33/1295; E21B 33/12955
See application file for complete search history.

(56) References Cited

U.S. PATENT DOCUMENTS 3,191,677 A * 6/1965 Kinley ..... E21B 29/10 166/277
5,014,779 A * 5/1991 Meling ..... B21D 41/02 166/55.7

(Continued)

FOREIGN PATENT DOCUMENTS

CN 1387603 A 12/2002
CN 1708631 A 12/2005

(Continued)

OTHER PUBLICATIONS

Office Action; Canadian Application No. 2,987,574; dated Aug. 31, 2018.

(Continued)

*Primary Examiner* — Blake E Michener
(74) *Attorney, Agent, or Firm* — Polsinelli PC

(57) ABSTRACT

A wellbore sealing assembly including a downhole device with a sealing sleeve coupled to the uphole end. The downhole device has an internal channel allowing fluid communication through the device that is substantially blocked when a ball is seated in the sleeve. The walls of the sleeve are elastically or plastically deformable, and are shaped to be deformed when the ball is seated. When deformed, the walls are in contact with the wellbore surface substantially blocking fluid communication around the device. Elastically deformable walls of the sleeve may further include a plastically deformable layer on its inner surface that, once deformed by the seating of the ball, keep the elastically deformed walls in contact with the wellbore surface when the ball is not seated.

20 Claims, 6 Drawing Sheets

(56) References Cited

U.S. PATENT DOCUMENTS

| | | | | |
|---|---|---|---|---|
| 8,950,504 | B2 | 2/2015 | Xu et al. | |
| 9,976,379 | B2 * | 5/2018 | Schmidt | E21B 23/01 |
| 2004/0262016 | A1 | 12/2004 | Farquhar | |
| 2006/0102360 | A1 * | 5/2006 | Brisco | E21B 43/105 166/380 |
| 2008/0264636 | A1 | 10/2008 | Stromquist et al. | |
| 2009/0056934 | A1 | 3/2009 | Xu | |
| 2010/0126714 | A1 * | 5/2010 | Ostevik | E21B 23/06 166/192 |
| 2012/0125619 | A1 | 5/2012 | Wood et al. | |
| 2012/0132440 | A1 * | 5/2012 | Xu | E21B 43/086 166/382 |
| 2013/0062063 | A1 | 3/2013 | Baihly et al. | |
| 2013/0092400 | A1 | 4/2013 | Stewart et al. | |
| 2013/0299185 | A1 | 11/2013 | Xu et al. | |
| 2014/0102709 | A1 | 4/2014 | Arabskyy | |
| 2014/0166292 | A1 | 6/2014 | Crowley et al. | |
| 2014/0246209 | A1 | 9/2014 | Themig et al. | |
| 2014/0290944 | A1 | 10/2014 | Kristoffer | |
| 2015/0013964 | A1 * | 1/2015 | Xu | E21B 23/01 166/135 |
| 2015/0129239 | A1 | 5/2015 | Richard | |
| 2017/0260825 | A1 * | 9/2017 | Schmidt | E21B 23/01 |
| 2019/0203557 | A1 * | 7/2019 | Dirocco | E21B 33/1208 |

FOREIGN PATENT DOCUMENTS

| | | | |
|---|---|---|---|
| CN | 102459806 | A | 5/2012 |
| CN | 104285032 | A | 1/2015 |

OTHER PUBLICATIONS

International Search Report and Written Opinion; PCT Application No. PCT/US2015/039640; dated Mar. 15, 2016.

Office Action; Chinese Application No. 201580080707.0; dated Jun. 4, 2019.

English abstract of CN104285032; retrieved from www.espacenet.com on Dec. 4, 2019.

English abstract of CN102459806; retrieved from www.espacenet.com on Dec. 4, 2019.

English abstract of CN1387603; retrieved from www.espacenet.com on Dec. 4, 2019.

English abstract of CN1708631; retrieved from www.espacenet.com on Dec. 4, 2019.

* cited by examiner

WELLBORE PLUG SEALING ASSEMBLY

CROSS-REFERENCE TO RELATED APPLICATIONS

This application is a national stage entry of PCT/US2015/039640 filed Jul. 9, 2015, said application is expressly incorporated herein in its entirety.

FIELD

The present disclosure relates generally to wellbore plugging operations. In particular, the subject matter herein generally relates to a downhole plug assembly that can be used to isolate sections within a wellbore.

BACKGROUND

Wellbores are drilled into the earth for a variety of purposes including accessing hydrocarbon bearing formations. A variety of downhole tools may be used within a wellbore in connection with accessing and extracting such hydrocarbons. Throughout the process, it may become necessary to isolate sections of the wellbore in order to create pressure zones. Downhole tools, such as frac plugs, bridge plugs, packers, and other suitable tools, may be used to isolate wellbore sections.

Downhole tools, such as frac plugs, are commonly run into the wellbore on a conveyance such as a wireline, work string or production tubing. Such tools typically have either an internal or external setting tool, which is used to set the downhole tool within the wellbore and hold the tool in place. Once in place, the downhole tools allow fluid communication between sections of the wellbore above the plug and below the plug until another downhole tool, such as a ball, is pumped down to seat in the plug and interrupt fluid communication through the plug, and a sealing assembly, which can be made of rubber and extends outwards to seal off the flow of liquid around the downhole tool.

BRIEF DESCRIPTION OF THE DRAWINGS

Implementations of the present technology will now be described, by way of example only, with reference to the attached figures, wherein.

DETAILED DESCRIPTION

Figure 1:
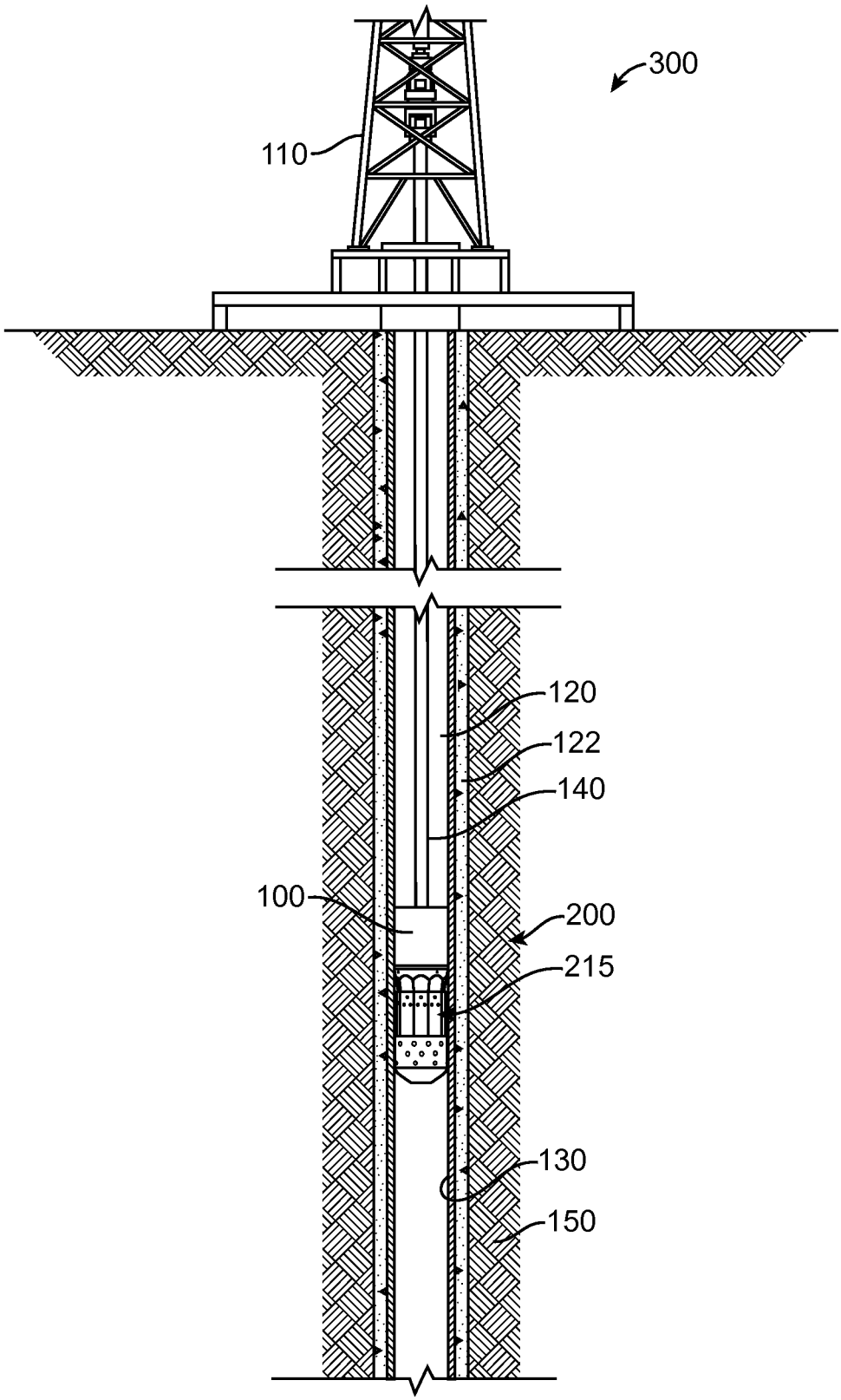
FIG. 1 is a diagram illustrating an exemplary environment for a sealing assembly according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Disclosed herein is a sealing assembly for substantially prohibiting fluid communication through and around a downhole tool within a wellbore. The sealing assembly as disclosed herein includes a sealing sleeve extending from the uphole end of the downhole tool and is shaped to seat a ball, and having deformable walls. When being seated into the sleeve, the ball can deform the walls such that the walls are forced into contact with the inner surface or casing of the wellbore. When seated, the ball substantially blocks fluid communication through the downhole tool, and the deformed walls substantially block fluid communication around the tool. Due to the deformability of the sleeve walls, the sealing process of a downhole tool may be simplified, and furthermore, the sealing apparatus may also permit the size of the downhole tool to be greatly decreased as well as allow for the omission of various internal setting mechanisms.

The sealing assembly disclosed herein may be used in combination with any of a variety of downhole tools, including, but not limited to, frac plugs, packers, and bridge plugs, or other tools with sealing assemblies.

A frac plug may include an elongated tubular body member with an axial flowbore or channel extending therethrough, and be used in combination with a ball, together acting as a one-way check valve. The ball, when seated on an upper surface of the flowbore, acts to seal off the flowbore and prevent flow downwardly therethrough, but permits flow upwardly through the flowbore. Frac plugs typically include a seating mechanism for the ball formed at the upper end of the tubular body member to retain the ball.

A packer generally includes a mandrel having an upper end, a lower end, and an inner surface defining a longitudinal central flow passage. More specifically, a packer element assembly can extend around the tubular body member; and include one or more slips mounted around the body member, above and below the packer assembly. The slips can be guided by mechanical slip bodies.

A bridge plug generally includes a plug mandrel, one or more slips, and a rubber sealing element and is typically used for zonal isolation within a wellbore. More specifically, a bridge plug is a mechanical device installed within a wellbore and used for blocking the flow of fluid from one part of the wellbore to another.

An anchoring assembly may also be included in a downhole tool such as a packer or a frac plug. An anchoring assembly allows the downhole tool to hold its position within the wellbore. For example, the anchoring assembly can include deformable locking arms, which can be deformed radially from the longitudinal axis of the wellbore plug, thereby engaging the wellbore casing or surface. Such anchoring assemblies can be engaged by movement of the downhole tool upward, forcing a portion of the downhole tool onto an internal wedge and expanding the locking arms outwardly toward the wellbore casing.

The wellbore sealing assembly can be employed in an exemplary wellbore system 300 shown, for example, in FIG.

1. A system 300 for sealing a downhole tool in a wellbore includes a drilling rig 110 extending over and around a wellbore 120. The wellbore 120 is within an earth formation 150 and has a casing 130 lining the wellbore 120, the casing 130 is held into place by cement 122. A downhole tool 200 includes a sealing sleeve 100 and an anchoring assembly 215. The downhole toll 200 can be moved down the wellbore 120 via a conveyance 140 to a desired location. A conveyance can be, for example, tubing-conveyed, wireline, slickline, work string, or any other suitable means for conveying downhole tools into a wellbore. Once the downhole tool 200 reaches the desired location, a setting device may be actuated to anchor the downhole tool into place. It should be noted that while FIG. 1 generally depicts a land-based operation, those skilled in the art would readily recognize that the principles described herein are equally applicable to operations that employ floating or sea-based platforms and rigs, without departing from the scope of the disclosure.

Figure 2:
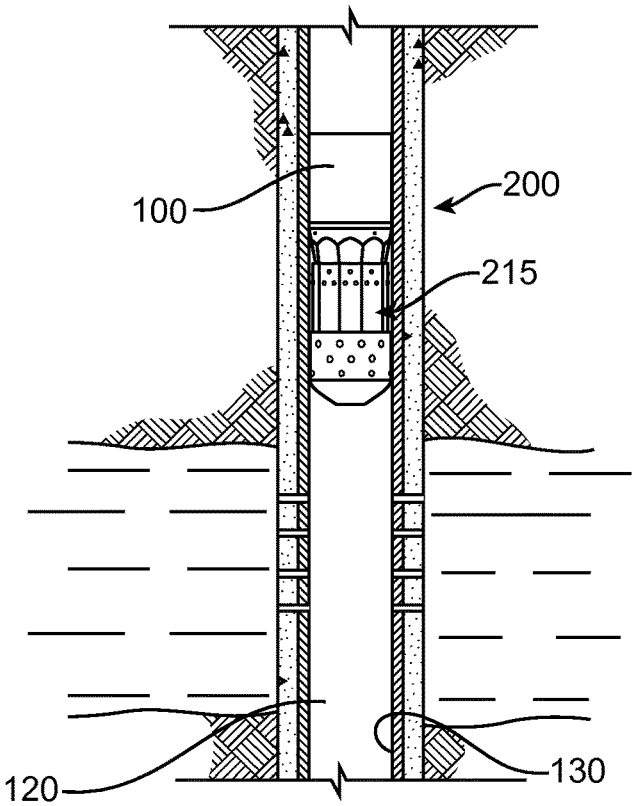
FIG. 2 is a diagram illustrating an exemplary environment for a sealing assembly in a resting configuration.
Figure 3:
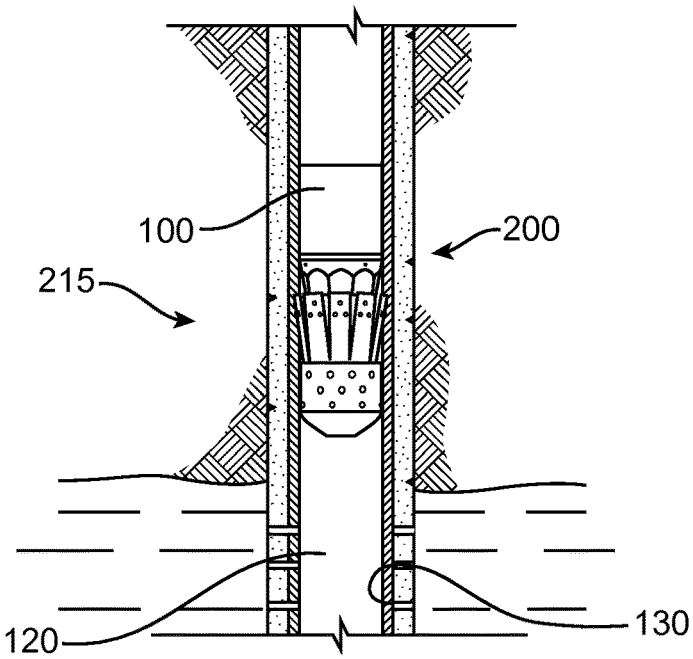
FIG. 3 is a diagram illustrating an exemplary environment for an sealing assembly in an engaged configuration.

FIG. 2 depicts an exemplary downhole tool in a resting configuration disposed within a wellbore 120. In the resting configuration, the anchoring assembly 215 is configured such that the downhole tool can be moved uphole or downhole without catching on the casing of the wellbore. Illustrated in FIG. 3 is the downhole tool 200 of FIG. 2 having anchoring assembly 215 in an engaged configuration, and the downhole tool is secured within the wellbore 120. In the engaged configuration, protrusions on the anchoring assembly 215 engage and grip the casing 130 lining the wellbore 120, such that the downhole tool 200 is fixed into place.

Figure 4:
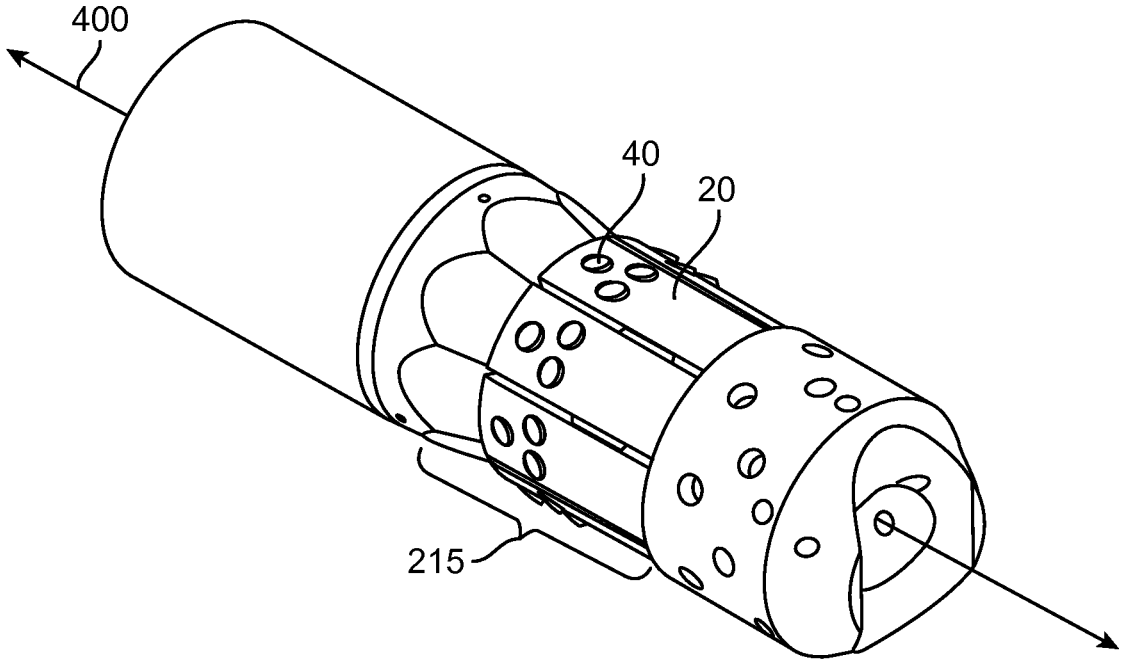
FIG. 4 is a diagram of a first exemplary embodiment of a downhole tool according to the present disclosure.

Illustrated in FIG. 4 is one example of the downhole tool 200 that can be used in the exemplary wellbore system 300 of FIG. 1. The downhole tool can include anchoring assembly 215 having a plurality of locking arms 20 deformable in a radial direction away from the longitudinal axis 400 of the downhole tool 200. The deformable locking arms 20 are configured such that when a force is applied to the inner surface of the locking arms 20, the locking arms 20 will become radially displaced with respect to the longitudinal axis 400 of the downhole tool 200. One or more gripping protrusions 40 can be located on the outer surface of the deformable locking arms 20. The gripping protrusion(s) 40 can be located along the length of the outer surface of the locking arms 20.

Figure 5:
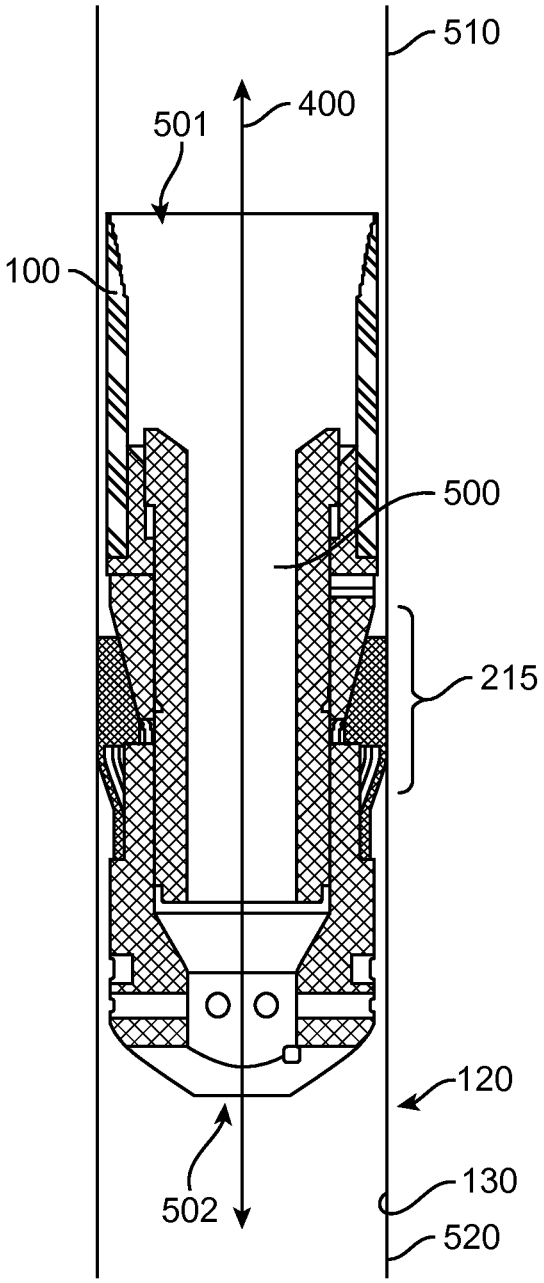
FIG. 5 is a cross-sectional diagram of the exemplary downhole tool of FIG. 4.

FIG. 5 illustrates a cross sectional view of downhole tool 200 including anchoring assembly 215 in the set configuration, and sealing sleeve 100 coupled to the uphole end of downhole tool 200. In this configuration, the protrusion(s) 40 of the locking arms 20 of the anchoring assembly 215 engage with the casing 130 of the wellbore 120 (as shown in FIG. 1), such that the downhole tool 200 is anchored into place. Internal channel 500 runs between uphole end 501 of downhole tool 200 and downhole end 502, and allows fluid communication through the downhole toll 200 between an uphole section 510 of wellbore 120 and downhole section 520 of wellbore 120.

Figure 6:
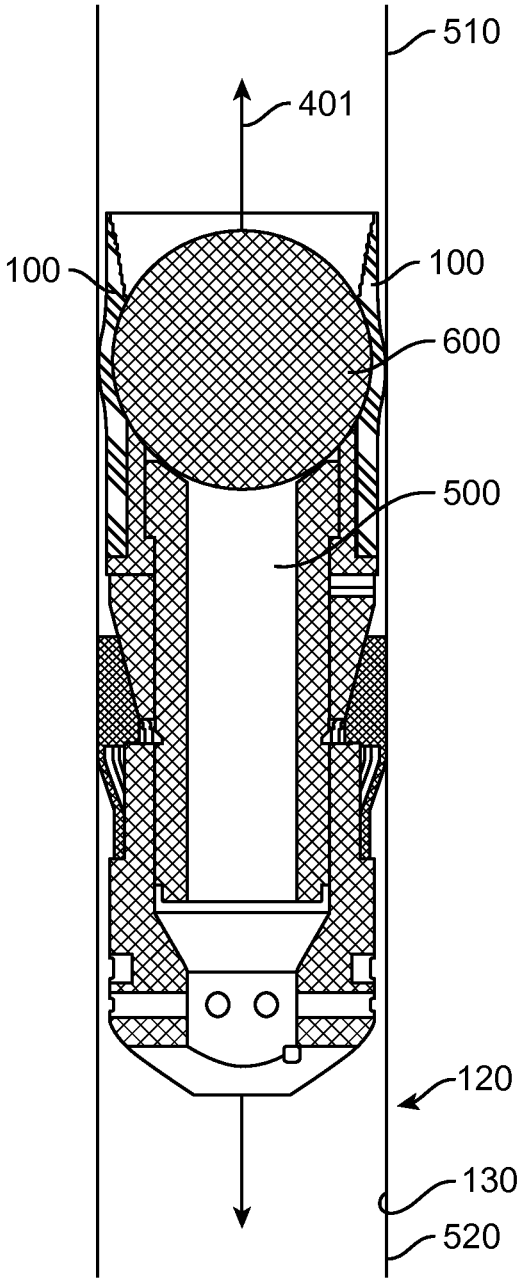
FIG. 6 is a diagram of the first exemplary sealing assembly according to the disclosure herein.

FIG. 6 illustrates a cross sectional view of downhole tool 200 including anchoring assembly 215 in the engaged configuration and sealing sleeve 100 seating ball 600. Ball 600 is typically pumped down wellbore 120 after downhole tool 200 has been fixed into place. When seated, ball 600 deforms the walls of sealing sleeve 100 radially away from longitudinal axis 400. Once seated, ball 600 blocks the uphole end of channel 500 substantially blocking fluid communication, through downhole tool 200, between uphole section 510 of wellbore 120 and downhole section 520. Fluid communication between sections 510 and 520 can be further blocked by shaping the walls of sealing sleeve 100 such that their deformation by the seating of ball 600 brings the walls of sealing sleeve 100 into contact with wellbore casing 130. This substantially seals wellbore 120 by further blocking fluid communication around downhole tool 200.

The walls of sealing sleeve 100 may be elastically or plastically deformable, and may be composed of any suitable elastically or plastically deformable material including, but not limited to, elastomers (including but not limited to rubber), polymers (including but limited to plastics), or metal. One of ordinary skill in the art will understand that the material selected and the deformable nature (elastic or plastic) is an understood design choice generally dictated by the application of the system and method described herein. Furthermore, one of ordinary skill in the art will understand that the material may be further selected to ease the removal of downhole tool 200 by, for example, choosing a material that easily broken up if drilled out or a material that is dissolvable.

Figure 7:
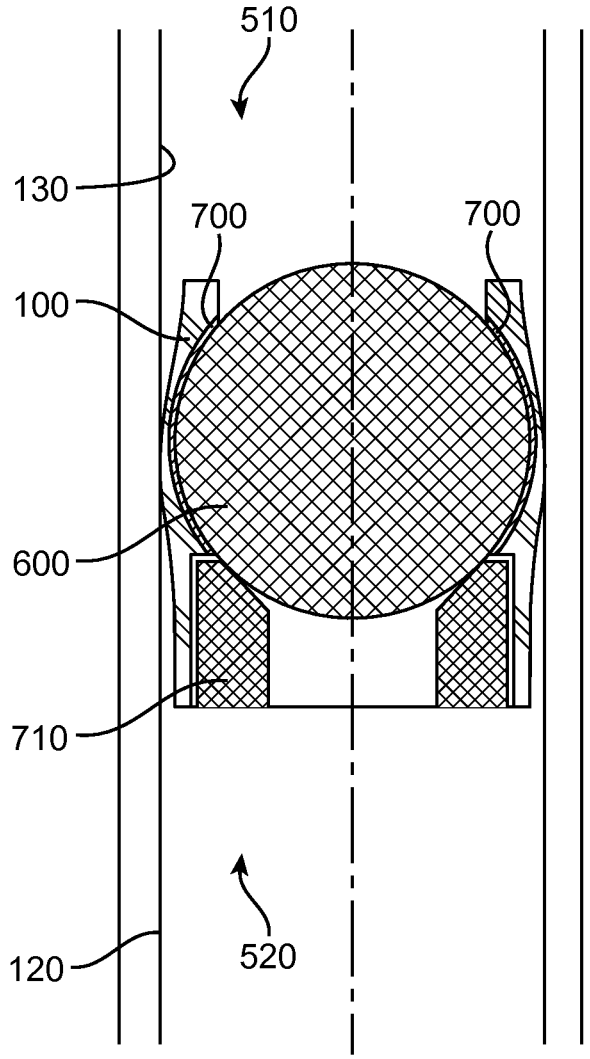
FIG. 7 is a cross-sectional diagram of a portion of the exemplary sealing assembly of FIG. 6.

FIG. 7 is a cross sectional view of the uphole portion of downhole tool 200 when ball 600 has been seated. Fluid communication between sections 510 and 520 of wellbore 120 is substantially blocked when ball 600 is seated in contact with baffles 710 and unblocked when ball 600 is not seated. However, if the walls of sealing sleeve 100 are elastically deformable, fluid communication around downhole tool 200 will lose the increased blockage of fluid communication around downhole tool 200 when ball 600 is not seated and the walls of sealing sleeve 100 are not deformed. Plastically deformable layer 700 can be placed on the inner surface of the walls of sealing sleeve 100, such that when ball 600 is being seated, the walls of sealing sleeve 100 are elastically deformed and plastically deformable layer 700 is plastically deformed. After deformation, plastically deformable layer 700 will maintain its deformation, holding the elastically deformed wall of sealing sleeve 100 in place. One of ordinary skill in the art will understand that the choice of materials for plastically deformable layer 700 is a design choice largely governed by application.

In the above description, reference to up or down is made for purposes of description with "up," "upper," "upward," "uphole," or "upstream" meaning toward the surface of the wellbore and with "down," "lower," "downward," "downhole," or "downstream" meaning toward the terminal end of the well, regardless of the wellbore orientation. Correspondingly, the transverse, axial, lateral, longitudinal, radial, etc., orientations shall mean orientations relative to the orientation of the wellbore or tool. The term "axially" means substantially along a direction of the axis of the object. If not specified, the term axially is such that it refers to the longer axis of the object.

Several definitions that apply throughout the above disclosure will now be presented. The term "coupled" is defined as connected, whether directly or indirectly through intervening components, and is not necessarily limited to physical connections. The connection can be such that the objects are permanently connected or releasably connected. The term "outside" or "outer" refers to a region that is beyond the outermost confines of a physical object. The term "inside" or "inner" refers to a region that is within the outermost confines of a physical object. The terms "comprising," "including" and "having" are used interchangeably in this disclosure. The terms "comprising," "including" and "having" mean to include, but not necessarily be limited to the things so described.

Numerous examples are provided herein to enhance understanding of the present disclosure. A specific set of statements are provided as follows.

Statement 1: A downhole tool sealing mechanism, comprising: a tubular body with a first end and a second end, allowing fluid communication along the longitudinal axis of the tubular body from the first end to the second end; a sleeve extending from the first end of the body shaped to seat a ball, and having radially deformable walls; and wherein the sleeve is shaped such that seating the ball substantially blocks the fluid communication through the tubular body when the ball is seated, and such that the ball radially deforms the walls during the seating.

Statement 2: The downhole tool sealing mechanism of Statement 1, wherein the sleeve walls are shaped such that deformation of the walls by the ball causes the walls to come into contact with a wellbore.

Statement 3: The downhole tool sealing mechanism of Statement 2, wherein the wellbore is substantially sealed when the ball is seated.

Statement 4: The downhole tool sealing mechanism of Statements 1-3, wherein the sleeve walls are elastically deformable.

Statement 5: The downhole tool sealing mechanism of Statements 4, wherein the sleeve walls are rubber.

Statement 6: The downhole tool sealing mechanism of Statements 1-5, further comprising: a plastically deformable layer on the inside surface of the sleeve.

Statement 7: The downhole tool sealing mechanism of Statement 6, wherein the seating of a ball plastically deforms the plastically deformable layer, and elastically deforms the deformable wall.

Statement 8: The downhole tool sealing mechanism of Statement 7, wherein the plastically deformed layer maintains the elastic deformation of the deformable wall when the ball is unseated.

Statement 9: A downhole tool sealing system, comprising: a tubular wellbore plug shaped to insert into a wellbore in the direction of plug's longitudinal axis; an internal channel along the longitudinal axis of the plug permitting fluid communication through the wellbore plug between wellbore sections uphole and downhole of the plug; a ball, insertable into the wellbore; a sleeve coupled to the uphole end of the plug shaped to seat the ball, and having deformable walls; wherein the sleeve is positioned to substantially block the fluid communication through the channel when the ball is seated, and wherein seating the ball deforms the walls into contact with a wellbore surface.

Statement 10: The downhole tool sealing system of Statement 9, wherein fluid communication around the wellbore plug is substantially blocked when the walls are deformed.

Statement 11: The downhole tool sealing system of Statements 9 or 10, wherein the sleeve walls are elastically deformable.

Statement 12: The downhole tool sealing system of Statement 11, wherein the sleeve walls are rubber.

Statement 13: The downhole tool sealing system of Statement 9-12, further comprising: a plastically deformable layer on the inside surface of the sleeve.

Statement 14: The downhole tool sealing system of Statement 13, wherein the seating of a ball plastically deforms the plastically deformable layer, and elastically deforms the deformable wall.

Statement 15: The downhole tool sealing system of Statement 14, wherein the plastically deformed layer maintains the elastic deformation of the deformable wall when the ball is unseated.

Statement 16: inserting into a wellbore a wellbore plug with an internal channel allowing fluid communication through the wellbore plug between a zone uphole of the plug and a zone downhole of the plug; providing a sealing sleeve on an uphole side of the plug with deformable walls shaped to be in close adjacent proximity to a wellbore surface when the plug is inserted into the wellbore; seating a sealing ball, sized to deform the walls of the sleeve and thereby bringing the sleeve walls into contact with the wellbore casing; and wherein the seating of the ball substantially blocks the fluid communication through the wellbore plug, and the sleeve wall deformation substantially seals the wellbore.

Statement 17: The method of sealing a wellbore zone Statement 16, wherein the sleeve walls are elastically deformable.

Statement 18: The method of sealing a wellbore zone of statement 16 or 17, further comprising: providing a plastically deformable layer on the inside surface of the sleeve.

Statement 19: The method of sealing a wellbore zone of Statement 18, wherein the seating of a ball plastically deforms the plastically deformable layer, and elastically deforms the deformable wall.

Statement 20: The method of sealing a wellbore zone of Statement 19, wherein the plastically deformed layer maintains the elastic deformation of the deformable wall when the ball is unseated.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A downhole tool sealing mechanism, comprising:

a tubular body with a first end and a second end, allowing fluid communication along the longitudinal axis of the tubular body from the first end to the second end;

a sleeve extending from the first end of the body shaped to seat a ball, the sleeve having radially deformable walls; and wherein the sleeve is shaped such that seating the ball substantially blocks the fluid communication through the tubular body when the ball is seated, and such that an outer surface of the ball directly contacts and urges an inner surface of the sleeve deforming the walls radially outward during the seating.

2. The downhole tool sealing mechanism of claim 1, wherein the sleeve walls are shaped such that deformation of the walls causes the walls to contact a wellbore surface when residing in a wellbore.

3. The downhole tool sealing mechanism of claim 2, wherein the wellbore is substantially sealed when the ball is seated.

4. The downhole tool sealing mechanism of claim 1, wherein the sleeve walls are elastically deformable.

5. The downhole tool sealing mechanism of claim 4, wherein the sleeve walls comprise an elastomer or polymer.

6. The downhole tool sealing mechanism of claim 1, further comprising:

a plastically deformable layer on the inside surface of the sleeve.

7. The downhole tool sealing mechanism of claim 6, wherein the seating of the ball plastically deforms the plastically deformable layer, and elastically deforms the deformable walls.

8. The downhole tool sealing mechanism of claim 7, wherein the plastically deformed layer maintains the elastic deformation of the deformable wall when the ball is unseated.

9. A downhole tool sealing system, comprising:

a tubular wellbore plug shaped to insert into a wellbore in the direction of plug's longitudinal axis;

an internal channel along the longitudinal axis of the plug permitting fluid communication through the wellbore plug between wellbore sections uphole and downhole of the plug;

a ball, insertable into the wellbore;

a sleeve coupled to the uphole end of the plug shaped to seat the ball, and having deformable walls;

wherein the sleeve is positioned to substantially block the fluid communication through the channel when the ball is seated, and wherein the sleeve is configured and ball sized such that when the ball is seated an outer surface of the ball directly contacts and urges an inner surface of the sleeve deforming the deformable walls radially outward into contact with a wellbore surface.

10. The downhole tool sealing system of claim 9, wherein fluid communication around the wellbore plug is substantially blocked when the walls are deformed.

11. The downhole tool sealing system of claim 9, wherein the sleeve walls are elastically deformable.

12. The downhole tool sealing system of claim 11, wherein the sleeve walls comprise an elastomer or polymer.

13. The downhole tool sealing system of claim 9, further comprising:

a plastically deformable layer on the inside surface of the sleeve.

14. The downhole tool sealing system of claim 13, wherein the seating of the ball plastically deforms the plastically deformable layer, and elastically deforms the deformable wall.

15. The downhole tool sealing system of claim 14, wherein the plastically deformed layer maintains the elastic deformation of the deformable wall when the ball is unseated.

16. A method of sealing a wellbore zone, comprising:

inserting into a wellbore a wellbore plug with an internal channel allowing fluid communication through the wellbore plug between a zone uphole of the plug and a zone downhole of the plug;

providing a sealing sleeve on an uphole side of the plug with deformable walls shaped to be in close adjacent proximity to a wellbore surface when the plug is inserted into the wellbore;

seating a sealing ball, such that an outer surface of the ball directly contacts and urges an inner surface of the sleeve radially outward deforming the walls thereby bringing the sleeve walls into contact with the wellbore casing; and wherein the seating of the ball substantially blocks the fluid communication through the wellbore plug, and the sleeve wall deformation substantially seals the wellbore.

17. The method of sealing a wellbore zone of claim 16, wherein the sleeve walls are elastically deformable.

18. The method of sealing a wellbore zone of claim 16, further comprising:

providing a plastically deformable layer on the inside surface of the sleeve.

19. The method of sealing a wellbore zone of claim 18, wherein the seating of the ball plastically deforms the plastically deformable layer, and elastically deforms the deformable wall.

20. The method of sealing a wellbore zone of claim 19, wherein the plastically deformed layer maintains the elastic deformation of the deformable wall when the ball is unseated.

* * * * *